US011624178B2

(12) United States Patent
Eto et al.

(10) Patent No.: US 11,624,178 B2
(45) Date of Patent: Apr. 11, 2023

(54) FLUSH TOILET

(71) Applicant: TOTO LTD., Kitakyushu (JP)

(72) Inventors: Yusuke Eto, Kitakyushu (JP); Takahiro Maruyama, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/678,245

(22) Filed: Feb. 23, 2022

(65) Prior Publication Data

US 2022/0275614 A1 Sep. 1, 2022

(30) Foreign Application Priority Data

Feb. 26, 2021 (JP) ..... JP2021-030142

(51) Int. Cl.

| | |
|---|---|
| ***E03D 1/012*** | (2006.01) |
| ***E03D 1/26*** | (2006.01) |
| ***E03D 5/01*** | (2006.01) |
| ***E03D 1/38*** | (2006.01) |
| ***E03D 11/08*** | (2006.01) |

(52) U.S. Cl.

CPC ..... *E03D 1/012* (2013.01); *E03D 1/26* (2013.01); *E03D 1/38* (2013.01); *E03D 5/01* (2013.01); *E03D 11/08* (2013.01)

(58) Field of Classification Search

CPC .. E03D 1/012; E03D 1/26; E03D 1/38; E03D 5/01; E03D 11/08; E03D 3/00; E03D 2201/30; E03D 11/06; E03D 1/00; E03D 1/30; E03D 1/32; E03D 5/10; E03D 11/13

USPC ..... 4/432

See application file for complete search history.

(56) References Cited

U.S. PATENT DOCUMENTS

| | | | | |
|---|---|---|---|---|
| 2015/0159356 | A1* | 6/2015 | Fukuya | E03D 5/01 4/329 |
| 2017/0350108 | A1* | 12/2017 | Harashima | E03D 5/01 |
| 2020/0308816 | A1 | 10/2020 | Kashirajima et al. | |

FOREIGN PATENT DOCUMENTS

| | | | |
|---|---|---|---|
| JP | 2014-37725 | A | 2/2014 |
| JP | 2015-175144 | A | 10/2015 |
| JP | 2017-89282 | A | 5/2017 |
| JP | 6712404 | B2 | 6/2020 |
| JP | 6778403 | B2 | 11/2020 |

* cited by examiner

*Primary Examiner* — Christine J Skubinna

(74) *Attorney, Agent, or Firm* — BakerHostetler

(57) ABSTRACT

A flush toilet in which a comparatively large storage region that stores a functional unit can be formed in a region in more rear side than a bowl of a toilet main body, while improving designability of the whole flush toilet is provided. A toilet main body of a flush toilet includes a skirt and a rear function storage portion, the skirt includes an opening, the opening being formed in a portion of an upper part of an outer wall of the skirt, the opening allowing the rear function storage portion inside the skirt to open toward outside the skirt, and a part of the functional unit stored in the rear function storage portion forms an outer surface to close the opening.

5 Claims, 8 Drawing Sheets

FLUSH TOILET

CROSS-REFERENCE TO RELATED APPLICATION

This application claims benefit of priority to Japanese Patent Application No. 2021-030142, filed on Feb. 26, 2021, the entire content of which is incorporated herein by reference.

BACKGROUND OF THE INVENTION

Technical Field

The present invention relates to a flush toilet, and more particularly, to a flush toilet which is flushed with flush water to discharge waste.

Background Art

Conventionally, there is known, as described in Patent Literature 1 (Japanese Patent Laid-Open No. 2014-37725), a flush toilet including a peripheral wall extending downward from an outer peripheral edge of an upper surface of a toilet main body, a so-called skirt, as a flush toilet which is flushed with flush water to discharge waste. In recent years, it has been considered that a functional unit for controlling discharging water from a toilet flush water tank or the like is disposed below an upper end of the skirt of the toilet main body made of ceramics in the flush toilet, with design diversification of the flush toilet and improvement in design such as appearance of the flush toilet.

Patent Literature 1 discloses that, to suppress enlarging of an external dimension of a toilet main body, a toilet flush water tank is disposed below the upper end of the skirt of the toilet main body made of ceramics in the flush toilet.

Also, Patent Literature 2 (Japanese Patent No. 6778403) discloses that a tank device is disposed below and behind an upper end of a toilet main body is not disposed in an inner side of a skirt. Further, Patent Literature 3 (Japanese Patent Laid-Open No. 2015-175144) discloses that a tank or the like is disposed below and behind an upper end of a toilet main body made of ceramics in a flush toilet and is not disposed in an inner side of a skirt.

SUMMARY OF INVENTION

Technical Problem

In the flush toilet described in Patent Literature 1, the functional unit for controlling the discharging water from the toilet flush water tank or the like is disposed in a lower part inside the skirt, and there is a problem that it is difficult to access the functional unit and do maintenance of the functional unit. If this functional unit is to be disposed in an upper part inside the skirt, it becomes necessary to further enlarge a storage region in a rear side of the toilet main body inside the skirt. In a case of forming the skirt in a larger area, there is a problem that the whole toilet main body enlarges and that designability of the whole flush toilet degrades.

Also, in the flush toilet described in Patent Literatures 2 and 3, the functional unit for controlling the discharging water from the tank or the like is disposed outside and behind the toilet main body. When this functional unit is applied to a flush toilet including a skirt extending to the rear side of the toilet main body and this functional unit is to be disposed inside the skirt, it becomes necessary to further enlarge the storage region in the rear side of the toilet main body inside the skirt. In the case of forming the skirt in the larger area, there is the problem that the whole toilet main body enlarges and that designability of the whole flush toilet degrades.

On the other hand, as in a flush toilet described in Patent Literature 4 (Japanese Patent No. 6712404), it is considered that an entire upper part in a rear side of a skirt is opened, and an entire storage tank or the like of a flush water tank device is disposed to be exposed in the rear side, to further enlarge a storage region of a functional unit. However, a gap for an attaching part or the like between the functional unit for the storage tank or the like and the skirt is formed to be comparatively large and exposed, and there is therefore a problem that designability of an opening part degrades. Also, since this gap is large, there is concern that dirt and water reach through the opening part to the functional unit inside to cause failure of the functional unit and that sanitary problem occurs. Note that the storage tank described in Patent Literature 4 is a gravity flush water tank device and does not include an electrically driven functional member energized for discharging water, and there is no problem that water reaches to an energized functional unit. In contrast, when the skirt made of ceramics is formed higher and the functional unit for controlling the discharging water is to be stored inside the skirt, the functional unit inside cannot be formed to a just size of the skirt due to shape variation of manufacturing error or the like of the ceramic skirt, and the functional unit has to be formed to a slightly smaller size by giving consideration to the manufacturing error. Thereby, there is a problem that it is difficult to acquire a comparatively large storage region sufficient to store the functional unit for controlling the discharging water simply by disposing the functional unit inside the skirt. Furthermore, when the sufficient storage region of the functional unit is to be simply acquired, it becomes necessary to form the skirt in a larger area, and there occurs again the problem that the whole toilet main body enlarges and that designability of the whole flush toilet degrades.

Accordingly, the present invention is aimed to solve problems of the conventional arts described above and is aimed to provide a flush toilet in which a comparatively large storage region that stores a functional unit can be formed in a region in more rear side than a bowl of a toilet main body, while improving designability of the whole flush toilet.

Solution to Problem

To achieve the aim described above, an aspect of the present invention is a flush toilet which is flushed with flush water to discharge waste, the flush toilet including a toilet main body made of ceramics and including a bowl that receives waste, and a water discharge trap portion wherein an inlet of the water discharge trap portion is connected to below the bowl and the water discharge trap portion discharges waste in the bowl, and a functional unit that is provided in more rear side than the bowl of the toilet main body and that includes a function of controlling discharging and stopping of flush water to the bowl, wherein the toilet main body further includes a skirt that forms an outer wall outside the bowl, and a rear function storage portion that is provided below an upper end of the skirt and in an inner side than the skirt, and that is provided in a region in more rear side than the bowl, and that is available for storing at least a part of the functional unit, the skirt includes an opening formed in a portion of an upper part of the outer wall of the skirt, the opening allowing the rear function storage portion inside the skirt to open toward outside the skirt, and a part of the functional unit stored in the rear function storage portion forms an outer surface to close the opening. According to the aspect of the present invention having such a configuration as described above, the skirt includes the opening, the opening being formed in the portion of the upper part of the outer wall of the skirt, the opening allowing the rear function storage portion inside the skirt to open toward outside the skirt, and the part of the functional unit stored in the rear function storage portion forms the outer surface to close the opening. Thereby, the part of the functional unit can form the outer surface to close the opening, so that designability of the opening formed in the skirt of the toilet main body can be improved, and designability of the whole flush toilet can be improved. Also, the part of the functional unit is formed to a position that forms the outer surface to close the opening, and hence the functional unit can be formed to a position to close the opening. In this case, as compared with a case where the functional unit is disposed in the rear function storage portion inside the outer wall in a state where the opening is not formed in the outer wall of the skirt, the larger rear function storage portion that stores the functional unit can be formed, and the functional unit can be disposed in a larger area from an interior of the rear function storage portion to an opening side. Furthermore, it is possible to suppress degrading the designability of the whole flush toilet to form the larger rear function storage portion. Also in the case of forming the comparatively large rear function storage portion the designability of the whole flush toilet can be improved.

In the aspect of the present invention, preferably, the functional unit in the rear function storage portion below the opening is disposed on an inner side than the outer wall of the skirt, and the functional unit includes a protruding portion that protrudes from the interior of the rear function storage portion through the opening to outside the opening. According to the aspect of the present invention having such a configuration as described above, the functional unit includes the protruding portion that protrudes from the interior of the rear function storage portion through the opening to outside the opening. Thereby, even when the outer wall of the skirt is formed from ceramics and the outer wall has dimensional variation, the larger storage region of the functional unit can be formed, and the functional unit can be disposed in a larger area to outside the opening irrespective of the outer wall. Also, it is possible to suppress degrading the designability of the whole flush toilet to form the larger rear function storage portion, and also in the case of forming the comparatively large rear function storage portion, the designability of the whole flush toilet can be improved.

In the aspect of the present invention, preferably, the functional unit includes a cover portion that forms the outer surface to close the opening, and the cover portion includes an inner part that extends from the outer surface to close the opening to inside of the outer wall of the skirt that forms the opening. According to the aspect of the present invention having such a configuration as described above, the functional unit includes the cover portion that forms the outer surface to close the opening, and the cover portion includes the inner part that extends from this outer surface to inside the outer wall of the skirt that forms the opening. Thereby, it is possible to suppress entering dirt and water through the opening on the functional unit including an energized part, and an object can be inhibited from physically colliding through the opening and causing damage to the functional unit. Therefore, it is possible to suppress the influence through the opening onto the functional unit.

In the aspect of the present invention, preferably, the cover portion further includes a lower part that extends from the inner part to a lower side of a downward facing surface of the functional unit. According to the aspect of the present invention having such a configuration as described above, the cover portion further includes the lower side part that extends from the inner part to the lower side of the downward facing surface of the functional unit. Therefore, it is possible to suppress a risk that water enter from the opening beyond the cover portion and to the functional unit including the energized part.

In the aspect of the present invention, preferably, the opening is formed in the outer wall facing rearward in the skirt. According to the aspect of the present invention having such a configuration as described above, the opening is formed in the outer wall facing rearward in the skirt. Thus, in this case, as compared with a case where the opening is formed in the outer wall facing sideways in the skirt, the opening is formed in a position in a rear side that is inconspicuous to a user, and it is possible to suppress impairing designability of the whole flush toilet. Also, it is possible to suppress a possibility that dirt, water, objects, and the like act reach to the functional unit through the opening, and it is possible to suppress the influence through the opening onto the functional unit.

Advantageous Effects of Invention

According to a flush toilet of an aspect of the present invention, a comparatively large storage region that stores a functional unit can be formed in a region in more rear side than a bowl of a toilet main body, while improving designability of the whole flush toilet.

DESCRIPTION OF EMBODIMENTS

Figure 1:
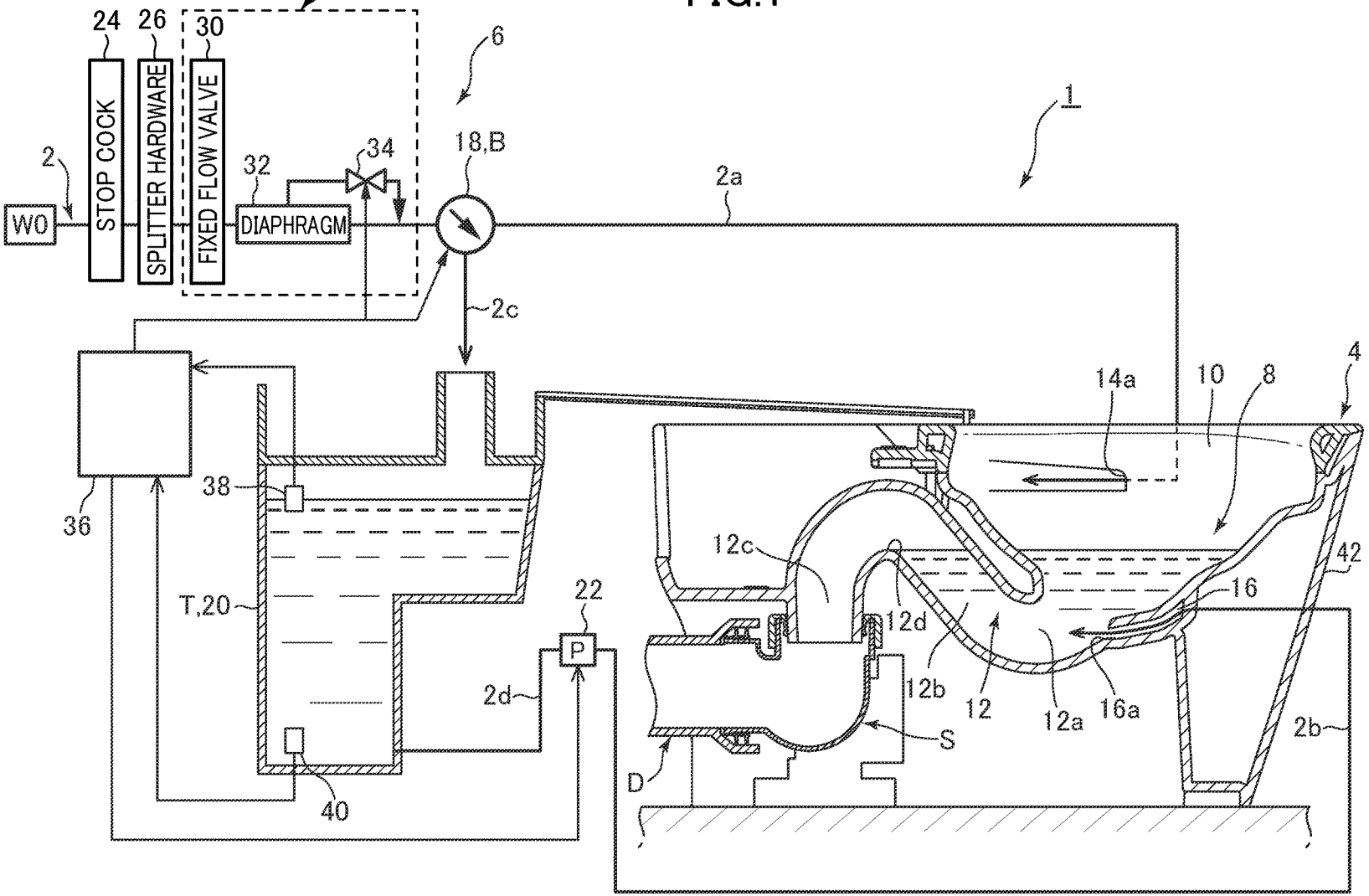
FIG. 1 is an overall structural diagram of a flush toilet according to an embodiment of the present invention.
Figure 2:
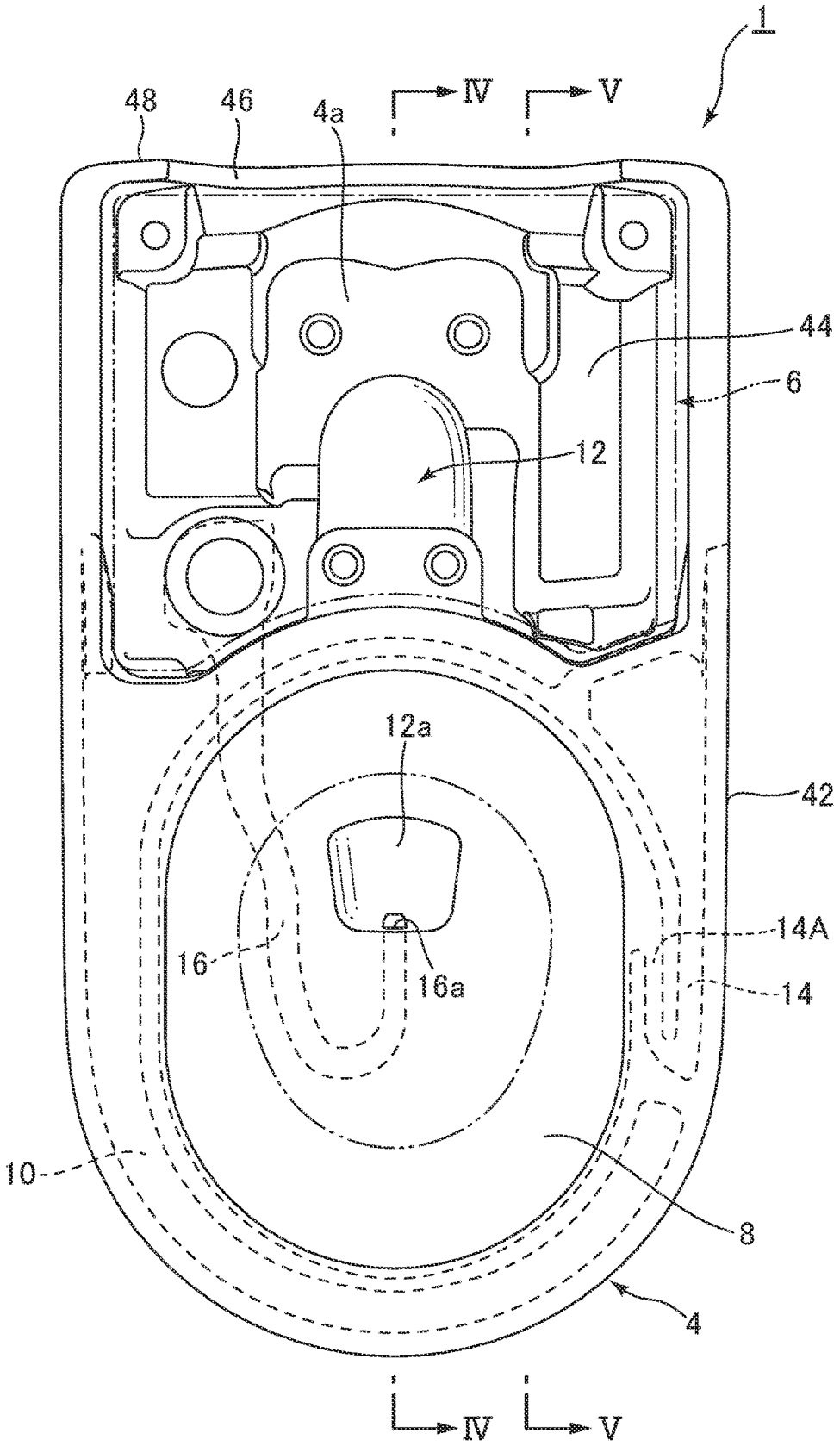
FIG. 2 is a plan view of the flush toilet according to the embodiment of the present invention.
Figure 3:
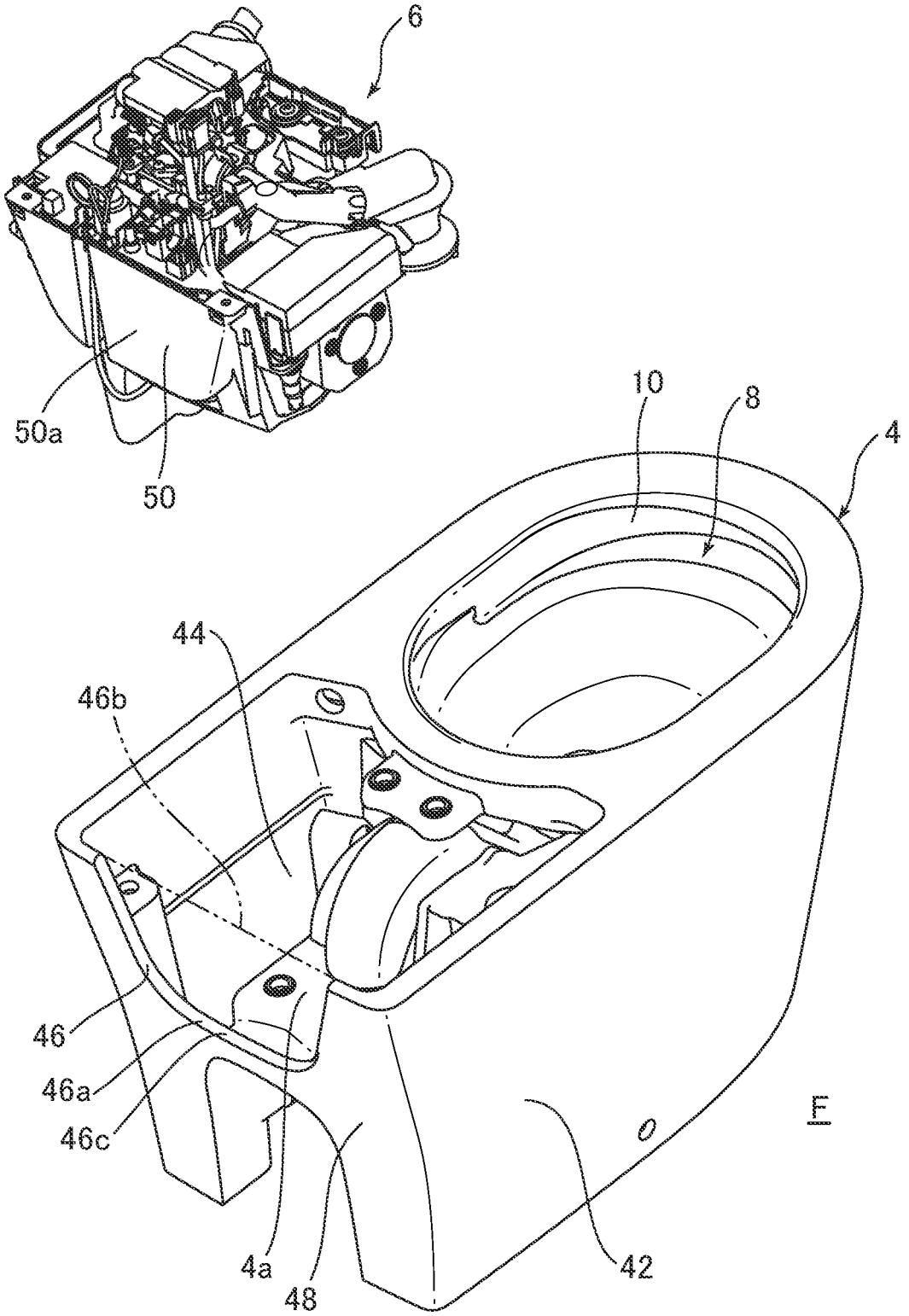
FIG. 3 is an exploded perspective view of the flush toilet according to the embodiment of the present invention seen from rear and diagonally above.
Figure 4:
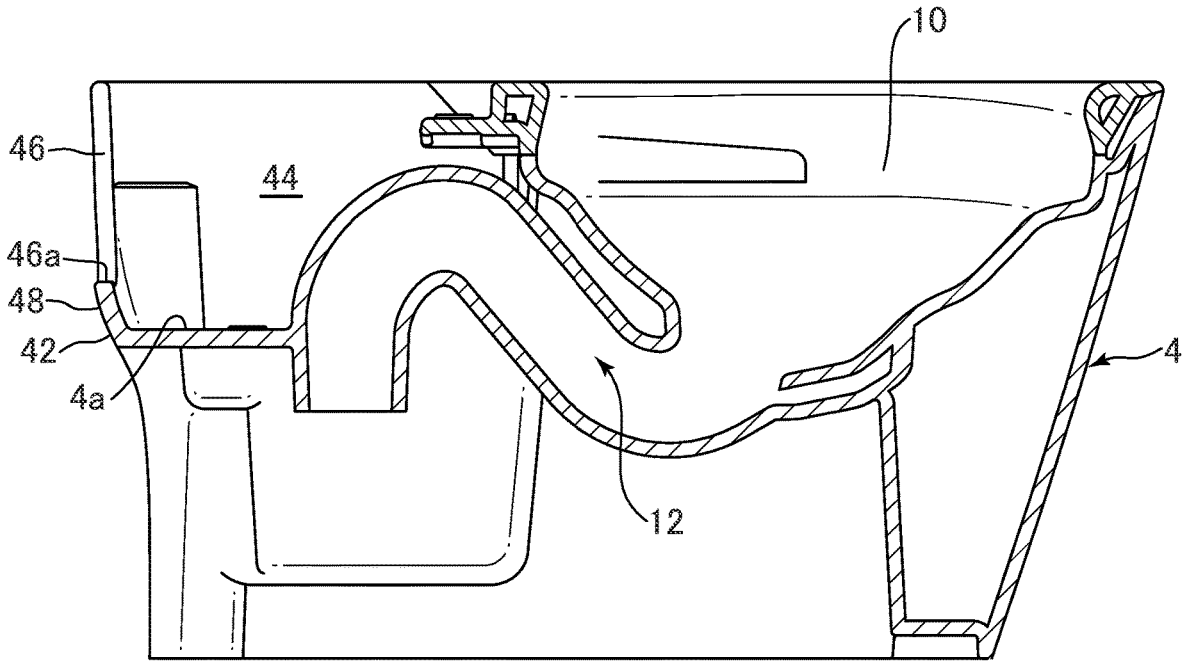
FIG. 4 is a cross-sectional view of a central side of the flush toilet according to the embodiment of the present invention, showing a state where a discharge socket and a drain pipe are not connected to a toilet main body.

Next, a flush toilet according to an embodiment of the present invention will be described with reference to the accompanying drawings. First, an entire configuration of the flush toilet according to the embodiment of the present invention will be schematically described with reference to FIGS. 1 to 3. FIG. 1 is an overall structural diagram of the flush toilet according to the embodiment of the present invention. Also, FIG. 2 is a plan view of the flush toilet according to the embodiment of the present invention. Furthermore, FIG. 3 is an exploded perspective view of the flush toilet according to the embodiment of the present invention seen from rear and diagonally above. As shown in FIGS. 1 to 3, a flush toilet 1 according to the embodiment of the present invention includes a main water passageway 2 that is a water supply channel where flush water that is supplied from a main water supply source WO such as a water system flows through, a toilet main body 4 made of ceramics, and a flush water supply device 6. In the following description about the embodiment of the present invention, a description is given taking a side closer to a user using the flush toilet 1 (a user who is standing in front of the flush toilet 1 to use the flush toilet 1) as a front side, a side that is away from the user as a rear side, a right side of the flush toilet 1 as seen from the front side as a right side, and a left side as seen from the front side as a left side.

Next, as shown in FIGS. 1 to 3, the toilet main body 4 includes a bowl 8 for receiving waste, a rim 10 that is formed in a top edge of the bowl 8, and a water discharge trap pipe 12 that is a water discharge trap portion extending from a bottom portion of the bowl 8. Furthermore, although details will be given later, the flush water supply device 6 is a functional unit that is provided in more rear side than the bowl 8 of the toilet main body 4 and that enables flush water supplied from the main water passageway 2 to be supplied to the toilet main body 4. This functional unit includes a function of controlling discharging and stopping of flush water to the bowl 8 of the toilet main body 4. The function is operated by electric power. The flush water supply device 6 may include other functional part other than the functional unit including the function of controlling the discharge and stopping of flush water. The functional unit of the flush water supply device 6 that includes the function of controlling the discharge and stopping of flush water is distinguished from a so-called sanitary washing device functional unit or the like that is driven to achieve a so-called sanitary washing device function of performing sanitary washing of user's buttocks. Note that a part of the so-called sanitary washing device functional unit may be disposed in a rear function storage portion 44, and an opening 46 is closed with a cover portion 50 mainly attached to a flush water supply device 6 side as described later. Thus, the flush water supply device 6 that is mainly disposed, as the functional unit for controlling discharging water, in the rear function storage portion 44 is distinguished from the sanitary washing device functional unit that is mainly disposed in an upper part of the toilet main body and that mainly includes a sanitary washing device side function. In a case where both the devices are structurally connected, a part on the flush water supply device 6 side is the functional unit. The flush water supply device 6 includes at least an after-mentioned electromagnetic valve 34 as the functional unit including the function of controlling the discharge and stopping of flush water and includes an electrical part that electrically drives the electromagnetic valve 34. Thereby, the flush water supply device 6 forms a functional unit such that an energized part such as the electromagnetic valve 34 is formed in the front side of the cover portion 50. For example, the flush water supply device 6 is formed as a functional unit that is structurally integrated with the electromagnetic valve 34 and formed as the integrated functional unit to be detachably attached to the toilet main body 4.

Next, as shown in FIG. 2, a rim conduit 14 is formed in the rim 10 on one of left and right sides (for example right side) of the toilet main body 4. The rim conduit 14 forms a so-called U-turn shape that extends forward from the rear side of the toilet main body 4 and then curved rearward from the middle part, in the right rim 10 of the toilet main body 4. Further, a rim spout port 14*a* is provided on a downstream side rear end of the rim conduit 14. Furthermore, a rim-side water supply channel 2*a* of the flush water supply device 6 which is described later, is connected in an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap pipe 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the water discharge trap pipe 12, and jet spouting is thus performed. Now, as shown in FIG. 1, an upstream side of the rim-side water supply channel 2*a* of the flush water supply device 6 is connected to a switching valve 18 (of which more later) at a branch part B on the main water passageway 2. On the other hand, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap pipe 12 of the toilet main body 4 is configured to discharge waste from an interior of the bowl 8. The water discharge trap pipe 12 includes the inlet 12*a* provided at the bottom portion of the bowl 8, a trap ascending pipe 12*b* that ascends from the inlet 12*a*, and a trap descending pipe 12*c* that descends from the trap ascending pipe 12*b*, and a part between the trap ascending pipe 12*b* and the trap descending pipe 12*c* is made a top portion 12*d*. Also, as shown in FIG. 1, an outlet of the trap descending pipe 12*c* of the water discharge trap pipe 12 is connected to an inlet of a discharge socket S that is disposed behind and below the toilet main body 4. Furthermore, as shown in FIG. 1, an outlet in the rear side of the discharge socket S is connected to an inlet of a drain pipe D extending from a wall (not shown) in the rear side of the toilet main body 4. Although the present embodiment shows the discharge socket S and the drain pipe D formed in the form of a wall drainage type, the discharge socket S and the drain pipe D may be formed in the form of a floor drainage type.

Next, each structure of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, splitter hardware 26, a valve unit 28, and the switching valve 18. Next, the valve unit 28 includes a fixed flow valve 30, a diaphragm main valve 32, and an electromagnetic valve 34 such as a solenoid valve.

Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22. The controller 36 includes an arithmetic device such as a CPU and a storage device such as a memory embedded therein and is capable of controlling electrically connected units according to predetermined control programs and the like. For example, the controller 36 stores, in the storage device, a control program for executing a function of controlling discharge and stopping of flush water as the above controller. The controller 36 is electrically connected to the electromagnetic valve 34, the switching valve 18, the pressure pump 22, and an operation unit or the like receiving user's operation input, in a wired or wireless manner. The controller 36 is provided to form an integrated functional unit with other structure in the flush water supply device 6, but is not limited to this example, and may be provided as another body at a position away from the other structure in the flush water supply device 6, in the upper side etc. of the toilet main body 4.

Moreover, the fixed flow valve 30 of the valve unit 28 is for reducing flush water flowing from the stop cock 24 on the main water passageway 2 and through the splitter hardware 26 to or below a predetermined flow rate. Additionally, in a construction where the flush toilet 1 is provided with a private part washing device (not shown), a water supply pipe (not shown) for supplying flush water to the private part washing device (not shown) may also be connected to the splitter hardware 26. Furthermore, at the valve unit 28, when an opening operation is performed on the electromagnetic valve 34 by the controller 36, the main valve 32 is opened, and flush water passing from the fixed flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pressure pump 22 for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided in the downstream side of the branch part B in the downstream side of the main water passageway 2. Accordingly, flush water that is supplied from the main water supply source WO to the branch part B of the main water passageway 2 is used as water to be supplied to at least one of the rim-side water supply channel 2*a* and the tank-side water supply channel 2*c*.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. On the other hand, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 sucks the flush water stored in the storage tank 20 into the pump water supply channel 2*d* and pressurizing the flush water from the pump water supply channel 2*d* into the jet-side water supply channel 2*b* and discharges the flush water from the jet spout port 16*a*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharge of water from the rim spout port 14*a* and the jet spout port 16*a* is thus sequentially started, and flush water used to flush the bowl 8 is drained from the water discharge trap pipe 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped.

Note that the controller 36 of the flush water supply device 6 may be disposed outside the rear function storage portion 44, for example, in a so-called sanitary washing device functional unit side, and may be electrically connected to the electromagnetic valve 34 and the like to perform wired or wireless communication.

Next, a specific description of a structure of the toilet main body 4 and the flush water supply device 6 will be given with reference to FIGS. 3 to 9. The toilet main body 4 further includes a skirt 42 that forms a vertical (standing) wall-shaped outer wall outside the bowl 8, and the rear function storage portion 44 that is provided below an upper end of the skirt 42 and in an inner side than the skirt 42 in a region in more rear side than the bowl 8, the rear function storage portion being available for storing at least a part of the flush water supply device 6.

The skirt 42 forms front, right, left, and rear exterior walls of the toilet main body 4. The skirt 42 is a skirt of a full skirt (total Hakama) type formed all around outside the toilet main body 4. In a case of forming the skirt 42 as the full skirt type, as compared with a case where the skirt 42 is provided only on the front side of the toilet main body 4, designability on appearance of the toilet main body 4 is improved, but when storing the functional unit inside the ceramic skirt 42, a size of the rear function storage portion inside tends to be restricted, because the skirt 42 is present all around. In the present embodiment, an inner storage space can be expanded, for example, by providing the opening 46 as described later. The skirt 42 basically forms a wall surface from a floor F on which the toilet main body 4 is installed to an upper part of the rim 10. The upper end of the skirt 42 is the upper part of the rim 10 and is formed at about the same height substantially all around the toilet main body 4 excluding a part of the opening 46. In the skirt 42, the opening 46 described later is formed, and an opening through which the drain pipe D or the like passes (e.g., a U-shaped opening below the opening 46 of FIG. 6) is formed as required. The skirt 42 is made of ceramics.

Figure 6:
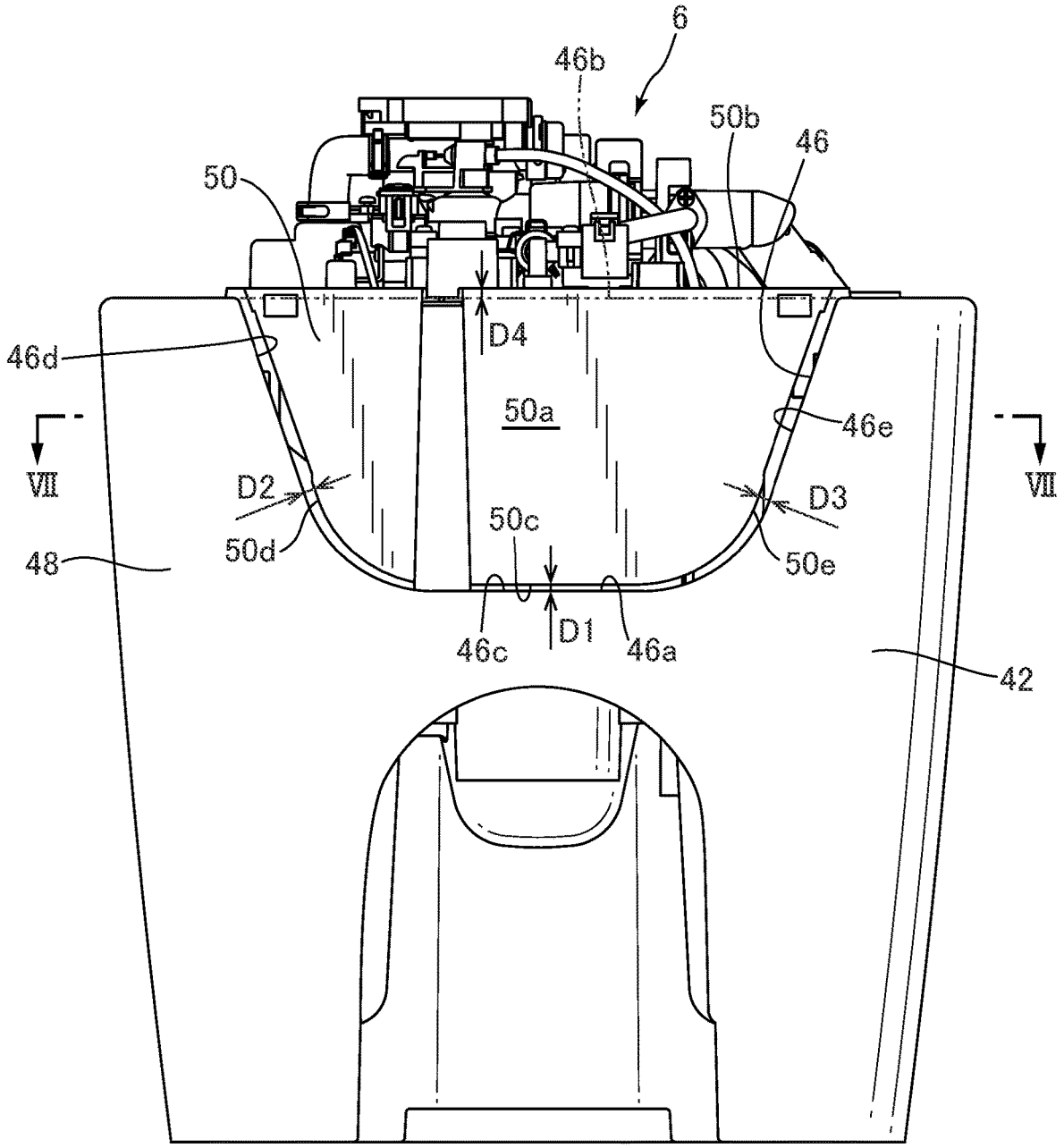
FIG. 6 is a rear view seen from behind the flush toilet according to the embodiment of the present invention.
Figure 7:
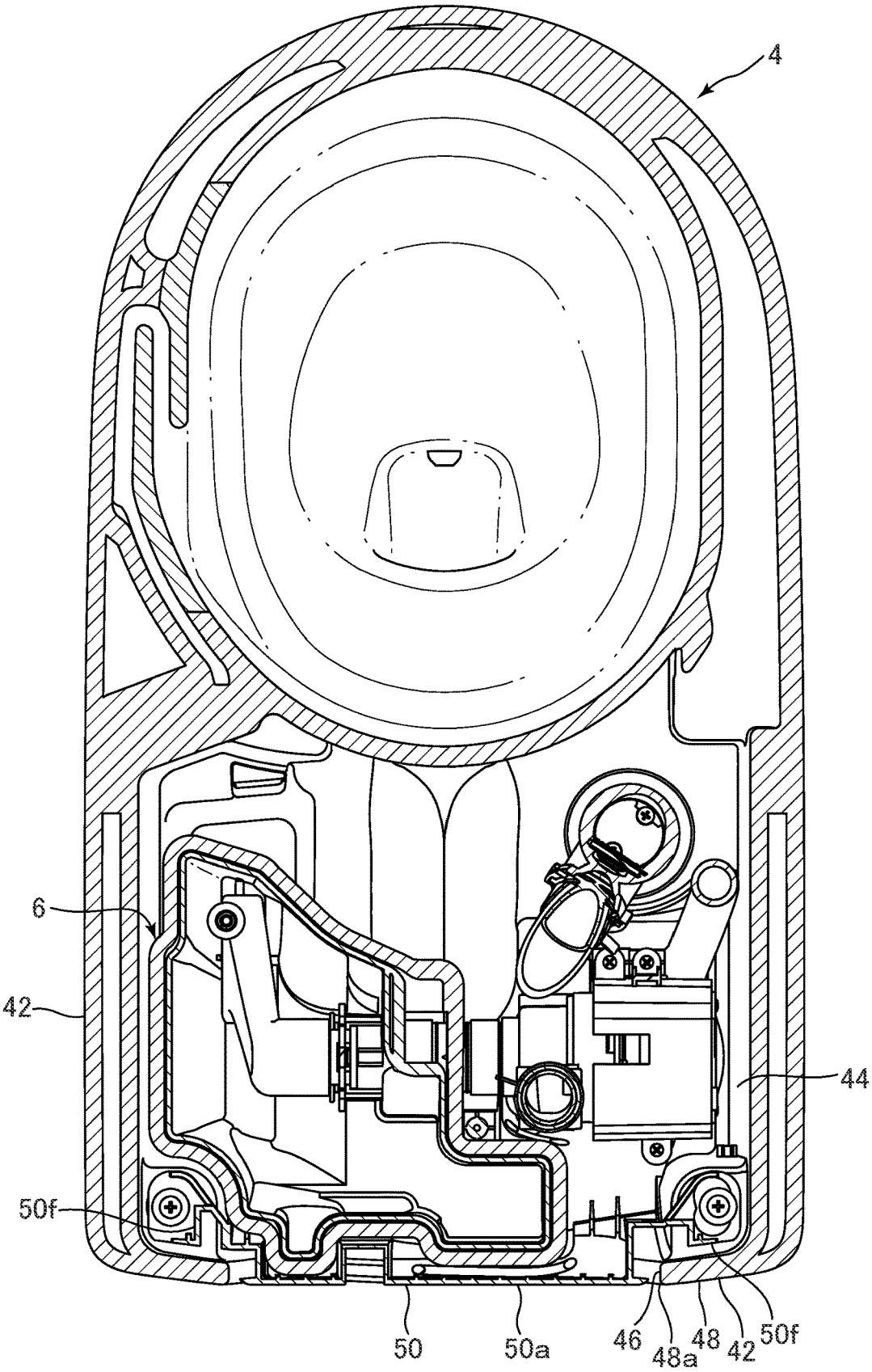
FIG. 7 is a cross-sectional view taken along a line VII-VII of FIG. 6.

As shown in FIG. 6, the skirt 42 includes the opening 46 formed in an upper part of an outer wall 48 of the skirt 42. The opening 46 is formed in the outer wall 48 facing rearward in the backside of the skirt 42. The opening 46 forms an opening part cut in a recess shape in the upper part of the outer wall 48. The opening 46 is formed by cutting a cut portion from the outer wall 48, the cut portion having a trapezoidal shape including a virtual upper side portion 46*b* shown with a virtual line in the upper part of the outer wall 48 (upper side portion that is virtually set by connecting left and right upper side portions of the outer wall 48), the upper side portion being parallel to a lower side portion 46*c*. Here, the opening 46 is specified as an opening having a height up to the virtual upper side portion 46*b* with a height of the upper part of the rim 10. Note that the opening 46 does not have to be necessarily formed in an uppermost part of the outer wall 48, and may be formed, for example, in an upper part or in a middle of the outer wall 48. That is, the outer wall 48 of the skirt 42 may be further formed above the opening 46. The opening 46 allows the rear function storage portion 44 inside the skirt 42 to open toward outside the skirt 42. The opening 46 exposes the flush water supply device 6 disposed in the rear function storage portion 44 inside the skirt 42 toward outside the skirt 42. The opening 46 forms an opening passage that communicates between the rear function storage portion 44 inside the skirt 42 and a space outside the skirt 42. Additionally, the opening 46 may be formed in the right or left outer wall 48 of the toilet main body 4.

Figure 5:
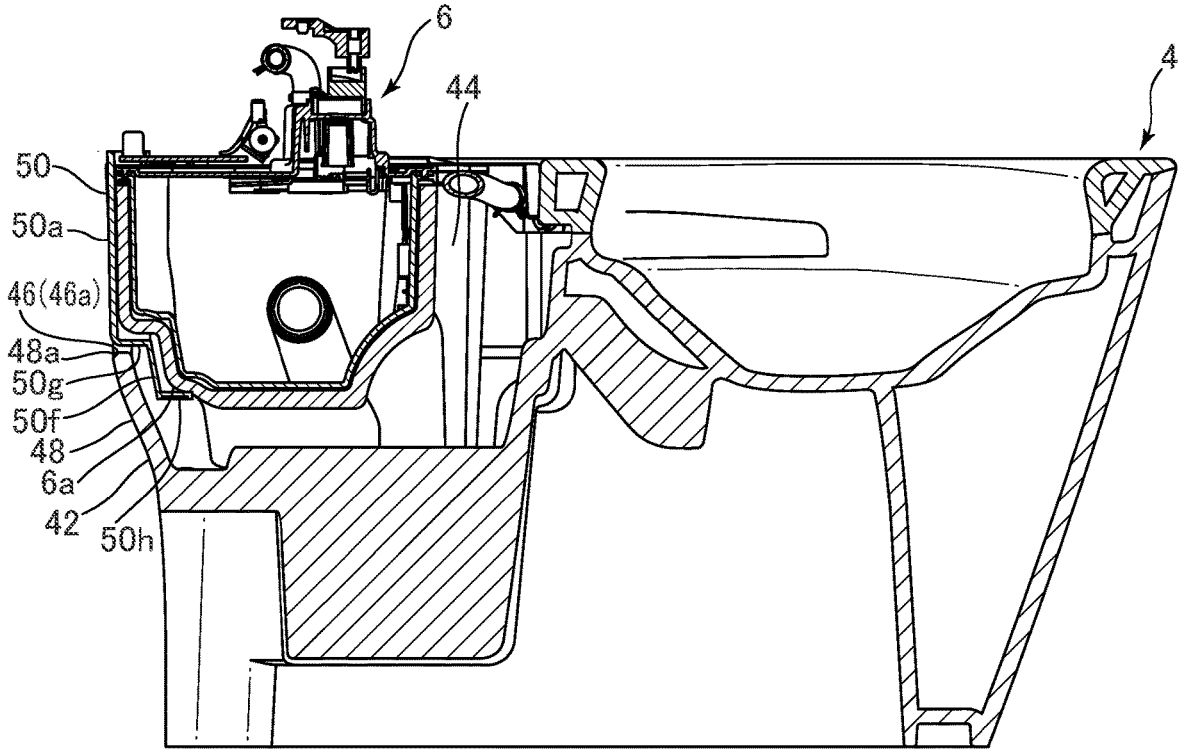
FIG. 5 is a cross-sectional view taken along a line V-V of FIG. 2.

A part of the flush water supply device 6 stored in the rear function storage portion 44 forms an outer surface 50*a* to close the opening 46. As shown in FIG. 5, the flush water supply device 6 (a part of the flush water supply device 6) in the rear function storage portion 44 below the opening 46 is disposed in an inner side than the outer wall 48 of the skirt 42.

As shown in FIGS. 5 and 6, the flush water supply device 6 further includes the cover portion 50 that is a protruding section protruding from an interior of the rear function storage portion 44 through the opening 46 to an outer side than the outer wall 48 forming the lower end 46*a* of the opening 46, in the upper side than the lower end 46*a* of the opening 46. The cover portion 50 forms the outer surface 50*a* to close the opening 46. In other words, the cover portion 50 of the flush water supply device 6 includes the outer surface 50*a* to close the opening 46. The cover portion 50 is fixed to the flush water supply device 6 and can be attached as an integrated unit to the rear function storage portion 44 in the flush water supply device 6, as shown in FIG. 3. The cover portion 50 is formed as a part of the flush water supply device 6. The cover portion 50 extends from the outer surface 50*a* to close the opening 46 to inside the outer wall 48 of the skirt 42 that forms the opening 46. The outer surface 50*a* forms a rear exposing part that faces rearward to close the opening 46. The cover portion 50 is a resin member made of a resin. The cover portion 50 is formed in same color as or similar color to that of the skirt 42, to make it easier to have design uniformity. Note that the cover portion 50 is not limited to the cover portion as a separate member from other member in the flush water supply device 6 and may be formed integrally with the other member in the flush water supply device 6.

Figure 8:
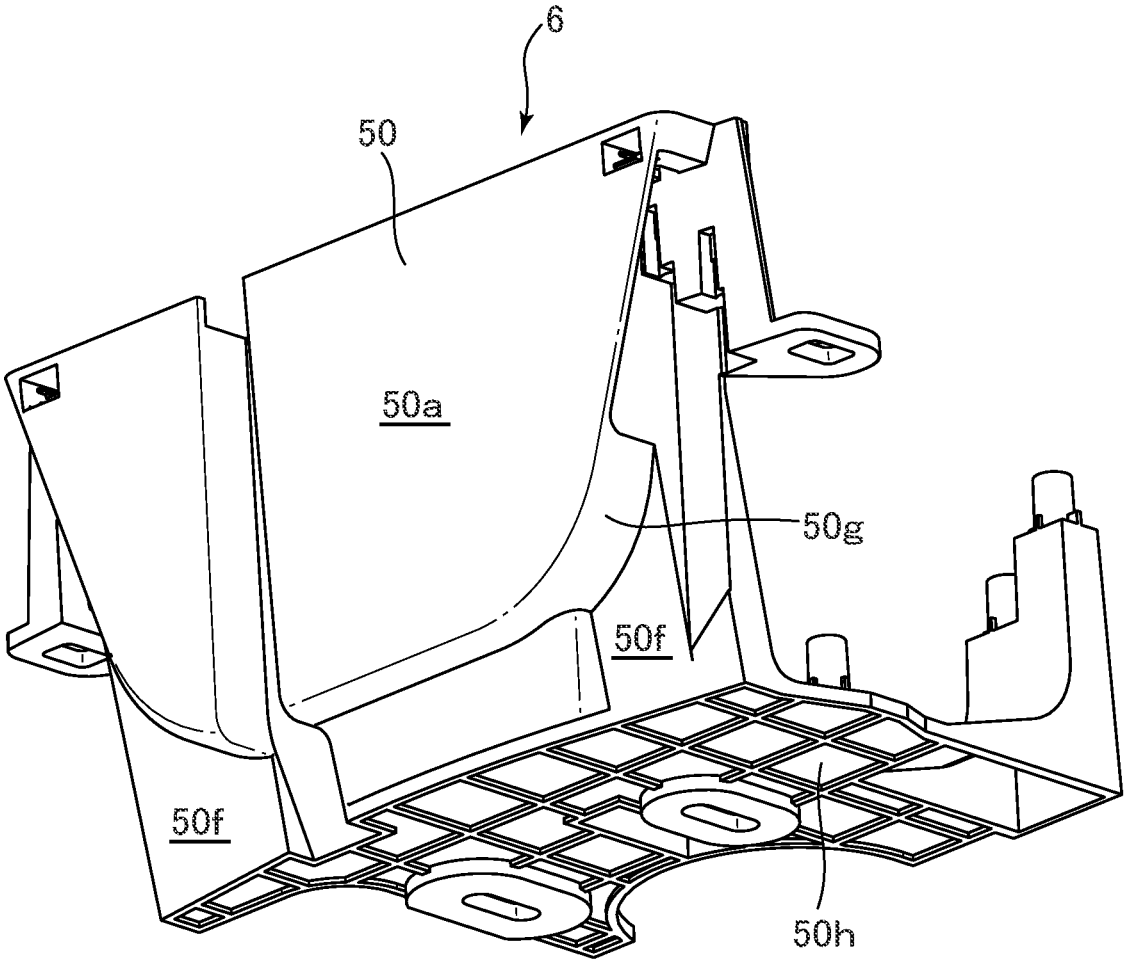
FIG. 8 is a perspective view of a cover portion of a flush water supply device of the flush toilet according to the embodiment of the present invention seen from rear and diagonally below.
Figure 9:
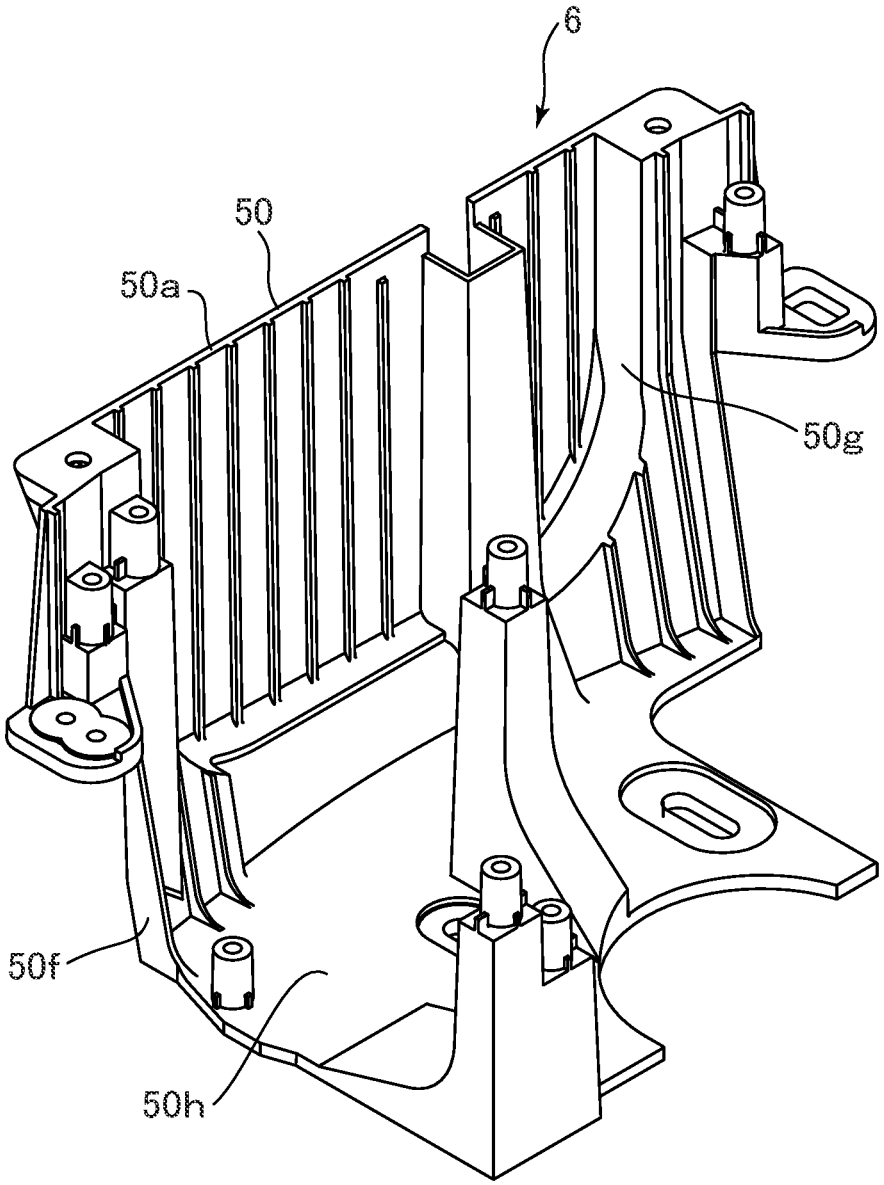
FIG. 9 is a perspective view of the cover portion of the flush water supply device of the flush toilet according to the embodiment of the present invention seen from front and diagonally above.

As shown in FIG. 8, the outer surface 50*a* is formed as a main rearward facing surface of the cover portion 50. The outer surface 50*a* forms a rearward facing surface in a rearmost side of the cover portion 50. The outer surface 50*a* is formed substantially parallel to the outer wall 48 in a vicinity. The outer surface 50*a* of the cover portion 50 mainly forms a wall surface panel to close the opening 46. The outer surface 50*a* is formed in a flat plate shape. The outer surface 50*a* may be provided with a partially recess or projection or the like. For example, as shown in FIG. 8 or the like, the outer surface 50*a* may include a groove part formed in an up-down direction and may be defined so as to divide by the groove part into the outer surface of a right part, the outer surface of a left part, and a rearward facing outer surface in the groove part.

The outer surface 50*a* is formed in a shape corresponding to a shape of the opening 46. For example, the outer surface 50*a* has an outer shape formed substantially along at least the lower side portion 46*c*, a right side portion 46*d*, and a left side portion 46*e* of the opening 46. More specifically, a lower side portion 50*c* of the outer surface 50*a* and the lower side portion 46*c* are arranged in parallel and arranged in a range of a distance D1 from 4 mm to 10 mm, for example, substantially at the distance D1 of 6 mm. Also, a right side portion 50*d* of the outer surface 50*a* and the right side portion 46*d* are arranged in parallel and substantially arranged in a range of a distance D2 from 1 mm to 11 mm, for example, at the distance D2 of 6 mm. Further, a left side portion 50*e* of the outer surface 50*a* and the left side portion 46*e* are arranged in parallel and substantially arranged in a range of a distance D3 from 1 mm to 11 mm, for example, at the distance D3 of 6 mm. Furthermore, the outer surface 50*a* has an outer shape substantially along the virtual upper side portion 46*b* of the opening 46. More specifically, an upper side portion 50*b* of the outer surface 50*a* and the virtual upper side portion 46*b* are arranged in parallel and substantially arranged in a range of a distance D4 from 3 mm to 9 mm, for example, at the distance D4 of 5 mm.

In front view seen from the rear side of the toilet main body 4, in most of the gap between the lower side portion 50*c* of the outer surface 50*a* and the lower side portion 46*c*, the cover portion 50 located in a further inner side than the gap can be seen. In most of the gap between the right side portion 50*d* of the outer surface 50*a* and the right side portion 46*d*, the cover portion 50 located in a further inner side than the gap can be seen. In most of gap between the left side portion 50*e* of the outer surface 50*a* and the left side portion 46*e*, the cover portion 50 located in a further inner side than the gap can be seen. Therefore, in front view seen from the rear side of the toilet main body 4, the cover portion 50 is formed to occupy a region in a range of preferably from 70% to 100%, a region in a range of more preferably from 80% to 100%, or a region in a range of further preferably from 90% to 100% of an open region inside the opening 46. Thereby, in front view seen from the rear side of the toilet main body 4, the cover portion 50 forms the outer surface to close the opening 46. Furthermore, the outer surface 50*a* of the cover portion 50 is formed to close the opening 46. In front view seen from the rear side the toilet main body 4, the cover portion is disposed to form a wall surface along which the outer surface 50*a* and the outer wall 48 are arranged, and the outer surface 50*a* forms a wall-shaped appearance that is continuous with the skirt 42, so that designability of the toilet main body can be improved.

The outer surface 50*a*, with a panel-shaped member that forms the outer surface, is formed at a position in more rear side than a rearmost end 48*a* (see FIGS. 5, 7 and the like) of the outer wall 48 that forms the opening 46. Furthermore, the outer surface 50*a* is made of the resin member, and therefore it is possible to be less shape variation due to manufacturing error as compared with a case of being made of a ceramic member, and other functional member or the like can be disposed and designed so as to be close to the outer surface 50*a*. Therefore, a region where the functional unit can be stored, for example, to hardly get wet on the front side of the outer surface 50*a* can be formed and specified more widely to a front side surface of the outer surface 50*a* (back side surface of the outer surface 50*a* when seen from rear). Thereby, the functional unit can be disposed to the front surface of the outer surface 50*a*. Thus, the outer surface 50*a*, as the panel member that forms the outer surface, can form the region that can store the functional unit, to the opening 46. Additionally, the outer surface 50*a* may forms the substantial same surface as the outer wall 48 that forms the opening 46 and may be located in more front side than the outer wall 48. Also in this case, with the member of the outer surface 50*a*, the region where the functional unit can be stored so as to hardly get wet in the front side of the outer surface 50*a* can be formed more widely to effectively use a region just before the front surface of the outer surface 50*a*.

The cover portion 50 further includes a collar part 50*f* that is an inner part formed in one step forward side than the rearward facing surface in the rearmost side, the inner part extending to inside of the outer wall 48 of the skirt 42 below the opening 46, and a connecting part 50*g* extending toward a frontside from the outer surface 50*a* toward the collar part 50*f*. The collar part 50*f* is formed to spread vertically and forms the rearward facing surface. The collar part 50*f* extends from a front end of the connecting part 50*g* in right-left and downward directions of the outer surface 50*a*. As shown in FIG. 5, the collar part 50*f* extends vertically in a state of being away from the outer wall 48 inside the outer wall 48. The rearward facing surface of the collar part 50*f* is formed, for example, in a range of a distance from 15 mm to 35 mm forward from a main rearward facing surface of the cover portion 50. The outer surface 50*a* may be specified to include not only the main rearward facing surface of the cover portion 50 but also a rearward facing surface of the connecting part 50*g* or the collar part 50*f*, a rearward facing surface in the groove part formed in the outer surface 50*a*, and the like.

The cover portion 50 further includes a lower side part 50*h* extending from the collar part 50*f* inside the outer wall 48 of the skirt 42 below the opening 46 to the lower side of a downward facing surface 6*a* (see FIG. 5) of the flush water supply device 6. The downward facing surface 6*a* of the flush water supply device 6 forms a surface of the flush water supply device 6 that faces downward. The downward facing surface 6*a* of the flush water supply device 6 is not limited to a lowermost surface and forms the surface of the flush water supply device 6 that faces downward.

As shown in FIG. 8, the lower side part 50*h* is formed in a plate shape from a lower end of the collar part 50*f* toward the front side. The lower side part 50*h* extends in the lower side of the downward facing surface 6*a* and is disposed to abut on the downward facing surface 6*a*. The lower side part 50*h* is brought into contact with and connected to the downward facing surface of the flush water supply device 6. The lower side part 50*h* receives load of the flush water supply device 6. The lower side part 50*h* is disposed and fixed onto a trapezoidal bottom portion 4*a* of the toilet main body 4. The trapezoidal bottom portion 4*a* forms a trapezoidal portion extending horizontally from the water discharge trap pipe 12 in a region in a vicinity of a center in the rear function storage portion 44. Therefore, the lower side part 50*h* in a disposed state is disposed between the flush water supply device 6 and the trapezoidal bottom portion 4*a* of the toilet main body 4. Note that the collar part 50*f* is formed not only in the lower side direction but also in a left-right direction, and a gap between the outer surface 50*a* and the opening 46 is covered with the collar part 50*f*. Thereby, the cover portion is formed in such a manner that waste or the like is hard to invade the cover portion from outside through the gap even when there is dimensional error in ceramics.

Next, description will be given to operation of the flush toilet 1 according to the above embodiment of the present invention. First, according to the flush toilet 1 of the embodiment of the present invention, the skirt 42 includes the opening 46, the opening being formed in a portion of the upper part of the outer wall 48 of the skirt 42, the opening 46 allowing the rear function storage portion 44 inside the skirt 42 to open toward outside the skirt 42. A part of the flush water supply device 6 stored in the rear function storage portion 44 forms the outer surface to close the opening 46. Thereby, a part of the flush water supply device 6 can form the outer surface to close the opening 46, so that designability of the opening 46 formed in the skirt 42 of the toilet main body 4 can be improved, and designability of the whole flush toilet 1 can be improved. Also, a part of the flush water supply device 6 is formed to a position that forms the outer surface to close the opening 46, so that the flush water supply device 6 can be formed to a position that closes the opening 46. In this case, as compared with a case where the flush water supply device 6 is disposed in the rear function storage portion 44 inside the outer wall 48 in a state where the opening 46 is not formed in the outer wall 48 of the skirt 42, the larger rear function storage portion that stores the flush water supply device 6 can be formed, and the flush water supply device 6 can be disposed in a larger area from the interior of the rear function storage portion 44 to an opening 46 side. Further, it is possible to suppress degrading the designability of the whole flush toilet 1 by enlarging the whole toilet main body 4 to form the larger rear function storage portion 44. Even in the case of forming the comparatively large rear function storage portion 44, the designability of the whole flush toilet 1 can be improved. Furthermore, the flush water supply device 6 is disposed to close the opening 46, so that it is easy to access the flush water supply device 6 and to maintenance of the flush water supply device 6 through the opening 46.

Also, according to the flush toilet 1 of the present embodiment, the flush water supply device 6 includes the cover portion 50 that protrudes from the interior of the rear function storage portion 44 through the opening 46 to outside the opening 46. Therefore, even in a case where the outer wall 48 of the skirt 42 is made of ceramics and the outer wall 48 has dimensional variation, the larger storage region of the flush water supply device 6 can be formed, and the flush water supply device 6 can be disposed in a larger area to outside the opening 46 irrespective of the outer wall 48. Also, it is possible to suppress degrading the designability of the whole flush toilet 1 to form the larger rear function storage portion 44, and also in the case of forming the comparatively large rear function storage portion 44 the designability of the whole flush toilet 1 can be improved.

Furthermore, according to the flush toilet 1 of the present embodiment, the cover portion 50 of the flush water supply device 6 forms the outer surface 50*a* to close the opening 46, and the cover portion 50 includes the collar part 50*f* that extends from the outer surface 50*a* to inside the outer wall 48 of the skirt 42 that forms the opening 46. Thereby, it is possible to suppress entering dirt and water through the opening 46 on the flush water supply device 6 including the energized part, and an object can be inhibited from physically colliding through the opening 46 and causing damage to the flush water supply device 6. Therefore, it is possible to suppress the influence through the opening 46 onto the flush water supply device 6.

Additionally, according to the flush toilet 1 of the present embodiment, the cover portion 50 further includes the lower side part 50*h* that extends from the collar part 50*f* to the lower side of the downward facing surface of the flush water supply device 6. Therefore, it is possible to suppress a risk that water enter from the opening 46 beyond the cover portion and to the flush water supply device 6 including the energized part.

According to the flush toilet 1 of the present embodiment, the opening 46 is formed in the outer wall 48 facing rearward in the skirt 42. In this case, as compared with a case where the opening 46 is formed in the outer wall 48 facing sideways in the skirt 42, the opening 46 is formed in a position in a rear side that is inconspicuous to a user, and it is possible to suppress impairing designability of the whole flush toilet 1. Also, it is possible to suppress a possibility that dirt, water, objects, and the like act reach to the flush water supply device 6 through the opening 46, and it is possible to suppress the influence through the opening 46 to the flush water supply device 6.

What is claimed is:

1. A flush toilet which is flushed with flush water to discharge waste, the flush toilet comprising:

a toilet main body made of ceramics and comprising a bowl that receives waste, and a water discharge trap portion wherein an inlet of the water discharge trap portion is connected to below the bowl and the water discharge trap portion discharges waste in the bowl, and a functional unit that is provided in a rear side more rear than the bowl of the toilet main body and that includes a function of controlling discharging and stopping of flush water to the bowl, wherein the toilet main body further comprises a skirt that forms an outer wall outside the bowl, and a rear function storage portion that is provided below an upper end of the skirt and in an inner side further inner than the skirt, and that is provided in a region in a rear side more rear than the bowl, and that is available for storing at least a part of the functional unit, the skirt comprises an opening formed in a portion of an upper part of the outer wall of the skirt, the opening allowing the rear function storage portion inside the skirt to open toward outside the skirt, and a part of the functional unit stored in the rear function storage portion forms an outer surface to close the opening above a lower end of the opening.

2. The flush toilet according to claim 1, wherein the functional unit in the rear function storage portion below the opening is disposed on an inner side than further than the outer wall of the skirt, and the functional unit comprises a protruding portion that protrudes from an interior of the rear function storage portion through the opening to outside the opening.

3. The flush toilet according to claim 1, wherein the functional unit comprises a cover portion that forms the outer surface to close the opening, and the cover portion comprises an inner part that extends from the outer surface to close the opening to inside of the outer wall of the skirt that forms the opening.

4. The flush toilet according to claim 3, wherein the cover portion further comprises a lower part that extends from the inner part to a lower side of a downward facing surface of the functional unit.

5. The flush toilet according to claim 1, wherein the opening is formed in the outer wall facing rearward in the skirt.

* * * * *